US011668149B2

(12) United States Patent
Leach et al.

(10) Patent No.: US 11,668,149 B2
(45) Date of Patent: Jun. 6, 2023

(54) RELIABILITY ASSESSABLE SYSTEMS FOR ACTUATING HYDRAULICALLY ACTUATED DEVICES AND RELATED METHODS

(71) Applicant: Transocean Innovation Labs Ltd., George Town (KY)

(72) Inventors: Andrew Leach, Houston, TX (US); Matthew Boike, Houston, TX (US); Stephen Fairfax, Houston, TX (US)

(73) Assignee: TRANSOCEAN INNOVATION LABS LTD., Grand Cayman (KY)

( * ) Notice: Subject to any disclaimer, the term of this patent is extended or adjusted under 35 U.S.C. 154(b) by 17 days.

(21) Appl. No.: 17/091,842

(22) Filed: Nov. 6, 2020

(65) Prior Publication Data

US 2021/0293111 A1 Sep. 23, 2021

Related U.S. Application Data

(63) Continuation of application No. 16/561,852, filed on Sep. 5, 2019, now abandoned, which is a continuation (Continued)

(51) Int. Cl.
*F15B 1/033* (2006.01)
*E21B 33/035* (2006.01)

(Continued)

(52) U.S. Cl.
CPC ..... *E21B 33/0355* (2013.01); *E21B 33/064* (2013.01); *F04B 1/12* (2013.01);

(Continued)

(58) Field of Classification Search
CPC ..... F15B 1/033; F15B 2201/51
See application file for complete search history.

(56) References Cited

U.S. PATENT DOCUMENTS 3,680,311 A 8/1972 Harbonn et al.
5,253,982 A 10/1993 Niemiec et al.

(Continued)

FOREIGN PATENT DOCUMENTS

JP 52-132401 U 10/1977
JP 04-017921 2/1992

(Continued)

OTHER PUBLICATIONS

International Search Report and Written Opinion in International Application No. PCT/US2016/062551 dated Feb. 2, 2017.

(Continued)

*Primary Examiner* — Kenneth Bomberg
*Assistant Examiner* — Michael Quandt
(74) *Attorney, Agent, or Firm* — Panitch Schwarze Belisario & Nadel LLP

(57) ABSTRACT

Some of the present systems include a hydraulic power storage system having an accumulator configured to supply pressurized hydraulic fluid to a hydraulically actuated device to actuate the hydraulically actuated device and a drain in fluid communication with the accumulator and including a valve that is actuatable to drain hydraulic fluid from the hydraulic power storage system such that an internal pressure of the accumulator is reduced and a flow restrictor configured to reduce a flow rate of hydraulic fluid through the valve, a hydraulic pump configured to pressurize the accumulator, a pressure sensor configured to capture data indicative of the internal pressure of the accumulator, and a processor configured to actuate the hydraulic pump to increase the internal pressure of the accumulator if the internal pressure of the accumulator, as indicated in data captured by the pressure sensor, falls below a threshold pressure.

16 Claims, 7 Drawing Sheets

Related U.S. Application Data of application No. 15/354,772, filed on Nov. 17, 2016, now abandoned.

(60) Provisional application No. 62/256,387, filed on Nov. 17, 2015.

(51) Int. Cl.

| | |
|---|---|
| ***F04B 23/06*** | (2006.01) |
| ***F04B 1/12*** | (2020.01) |
| ***F04B 11/00*** | (2006.01) |
| ***F04B 23/02*** | (2006.01) |
| ***F04B 49/08*** | (2006.01) |
| ***F04B 49/06*** | (2006.01) |
| ***F04B 49/20*** | (2006.01) |
| ***F04B 17/03*** | (2006.01) |
| ***E21B 33/064*** | (2006.01) |
| ***F15B 1/04*** | (2006.01) |
| ***F15B 11/08*** | (2006.01) |

(52) U.S. Cl.

CPC ..... *F04B 11/0008* (2013.01); *F04B 17/03* (2013.01); *F04B 23/02* (2013.01); *F04B 23/06* (2013.01); *F04B 49/06* (2013.01); *F04B 49/065* (2013.01); *F04B 49/08* (2013.01); *F04B 49/20* (2013.01); *F15B 1/033* (2013.01); *F15B 1/04* (2013.01); *F15B 11/08* (2013.01); *F15B 2201/411* (2013.01); *F15B 2201/51* (2013.01); *F15B 2211/205* (2013.01); *F15B 2211/20576* (2013.01); *F15B 2211/212* (2013.01); *F15B 2211/30505* (2013.01); *F15B 2211/632* (2013.01); *F15B 2211/6306* (2013.01)

(56) References Cited

U.S. PATENT DOCUMENTS

| | | | |
|---|---|---|---|
| 5,377,717 | A | 1/1995 | Toogood et al. |
| 5,630,316 | A | 5/1997 | Itsuji et al. |
| 5,687,567 | A | 11/1997 | Hansson et al. |
| 8,156,953 | B2 | 4/2012 | Treita |
| 8,226,370 | B2 | 7/2012 | Wu et al. |
| 9,249,646 | B2 | 2/2016 | Hannegan et al. |
| 9,376,875 | B2 | 6/2016 | Reitsma et al. |
| 2005/0178560 | A1 | 8/2005 | Johansen et al. |
| 2008/0223467 | A1 | 9/2008 | Tveita |
| 2009/0126798 | A1 | 5/2009 | Mather |
| 2013/0118752 | A1 | 5/2013 | Weatherford |
| 2013/0179046 | A1 | 7/2013 | Nassouri et al. |
| 2014/0131049 | A1 | 5/2014 | Bourgeau |
| 2015/0083429 | A1 | 3/2015 | Reitsma et al. |
| 2017/0138142 | A1 | 5/2017 | Leach et al. |
| 2020/0199960 | A1 | 6/2020 | Leach et al. |

FOREIGN PATENT DOCUMENTS

| | | | |
|---|---|---|---|
| JP | 07-027101 | A | 1/1995 |
| JP | H08-145002 | A | 6/1996 |
| JP | 3525932 | B | 5/2004 |
| JP | 2011-179735 | A | 9/2011 |
| JP | 2015-533395 | | 5/2014 |
| JP | 2016-011839 | A | 1/2016 |
| JP | 06-020965 | U | 11/2016 |
| WO | WO 1995/33629 | A1 | 12/1995 |
| WO | WO 2010/063377 | A1 | 6/2010 |
| WO | WO 2014/074745 | A1 | 5/2014 |

OTHER PUBLICATIONS

Office Action issued by the United States Patent and Trademark Office for U.S. Appl. No. 15/354,772, dated Mar. 5, 2019, 20 pages.

Extended European Search Report issued by the European Patent Office for Application No. 16867145.1, dated Jun. 11, 2019, 9 pages.

Written Opinion issued by the Singaporean Patent Office for Application No. 11201804122P, dated Aug. 28, 2019, 9 pages.

Office Action issued by the European Patent Office for Application No. 16867145.1, dated May 6, 2020, 7 pages.

Final Office Action issued by the United States Patent and Trademark Office for U.S. Appl. No. 16/561,852, dated Jun. 11, 2020 19 pages.

Office Action issued by the Brazil Patent Office for Application No. BR1120180100536, dated Jul. 7, 2020, 7 pages including English translation.

Written Opinion issued by the Singaporean Patent Office for Application No. 11201804122P, dated Oct. 12, 2020, 7 pages.

Office Action issued by the Japanese Patent Office for Application No. 2018-525674, dated Oct. 2, 2020, 7 pages including English translation.

Office Action issued by the European Patent Office for Application No. 16867145.1, dated Nov. 11, 2020, 5 pages.

Office Action issued by the Australian Patent Office for Application No. 2016356783, dated Sep. 25, 2020, 5 pages.

Office Action dated Jan. 18, 2023 in Canadian Application No. 3,005,441.

RELIABILITY ASSESSABLE SYSTEMS FOR ACTUATING HYDRAULICALLY ACTUATED DEVICES AND RELATED METHODS

CROSS-REFERENCE TO RELATED APPLICATION

This application is a continuation of U.S. application Ser. No. 16/561,852, filed Sep. 5, 2019, entitled "Reliability Assessable Systems for Actuating Hydraulically Actuated Devices and Related Methods", which is a continuation of U.S. application Ser. No. 15/354,772, filed Nov. 17, 2016, entitled "Reliability Assessable Systems for Actuating Hydraulically Actuated Devices and Related Methods", which claims priority to U.S. Provisional Application No. 62/256,387, filed Nov. 17, 2015, entitled "Reliability Assessable Systems for Actuating Hydraulically Actuated Devices and Related Methods", the entire content of each of which is incorporated herein by reference.

BACKGROUND

1. Field of Invention

The present invention relates generally to subsea blowout preventers, and more specifically, but not by way of limitation, to reliability assessable systems for actuating subsea hydraulically actuated devices (e.g., for use as secondary, back-up, and/or emergency systems) and related methods.

2. Description of Related Art

A blowout preventer (BOP) stack and/or lower marine riser package (LMRP) may be used to seal, control, and/or monitor an oil and gas well. Such BOP stacks and/or LMRPs typically include a number of devices, such as, for example, BOPs (e.g., rams, annulars, and/or the like), test valves, kill and/or choke lines and/or valves, riser connectors, hydraulic connectors, and/or the like, many of which may be hydraulically actuated.

Such hydraulically actuated devices (amongst others) typically require a source of high pressure hydraulic fluid for actuation. Under usual circumstances, such high pressure hydraulic fluid may be provided by a hydraulic power unit located above sea (e.g., on a drilling rig). Due at least in part to the magnitude of harm that may result from a BOP stack or LMRP failure, a subsea secondary, back-up, or emergency source of high pressure hydraulic fluid is often required.

Many existing systems use a series of accumulators as a subsea source of high pressure hydraulic fluid. To be effective, such accumulators need to be able to provide hydraulic fluid in a sufficient volume and at a sufficient pressure and flow rate to actuate the hydraulically actuated device(s) that the accumulators are intended to actuate. However, as depth below the sea surface increases, rising hydrostatic pressure may result in a decrease in the usable volume of such accumulators, thereby necessitating larger and/or additional accumulators to meet hydraulic fluid volume requirements to actuate some hydraulically actuated devices. Additionally, it may be difficult to ascertain whether an accumulator will properly function when required, and thus, accumulators are typically assigned a relatively high probability of failure on demand.

SUMMARY

Some embodiments of the present systems are configured, through an accumulator configured to supply pressurized fluid to a hydraulically actuated device to actuate the hydraulically actuated device and a (e.g., battery powered) hydraulic pump configured to pressurize the accumulator and/or supply pressurized fluid to the hydraulically actuated device to actuate the hydraulically actuated device, to, for example, provide for multiple (e.g., redundant and/or supplementary) sources of high pressure hydraulic fluid, resistance to depth-related limitations on usable hydraulic fluid volume within the accumulator (e.g., allowing for a degree of depth independence), and/or the like.

Some embodiments of the present systems are configured, through a hydraulic power storage system, including an accumulator and a drain in fluid communication with the accumulator and configured to drain hydraulic fluid from the hydraulic power storage system, and a hydraulic pump configured to pressurize the accumulator if an internal pressure of the accumulator falls below a threshold pressure, to, for example, provide for assessable reliability of system components (e.g., the accumulator, the hydraulic pump, and/or the like) through automatic, periodic, and/or self-testing, thereby providing for a source of high pressure hydraulic fluid with a relatively low probability of failure on demand.

Some embodiments of the present systems for actuating a hydraulically actuated device comprise: a hydraulic power storage system including an accumulator configured to supply pressurized hydraulic fluid to a hydraulically actuated device to actuate the hydraulically actuated device, a drain in fluid communication with the accumulator and comprising a valve that is actuatable to drain hydraulic fluid from the hydraulic power storage system such that an internal pressure of the accumulator is reduced and a flow restrictor configured to reduce a flow rate of hydraulic fluid through the valve, a hydraulic pump configured to pressurize the accumulator, a pressure sensor configured to capture data indicative of the internal pressure of the accumulator, and a processor configured to actuate the hydraulic pump to increase the internal pressure of the accumulator if the internal pressure of the accumulator, as indicated in data captured by the pressure sensor, falls below a threshold pressure. In some embodiments, the system is configured to be coupled to a blowout preventer (BOP) stack. In some embodiments, the system is configured to be mounted on a skid. In some embodiments, the hydraulic fluid comprises at least one of: sea water, desalinated water, treated water, and an oil-based fluid.

In some embodiments, the accumulator comprises a bladder-type accumulator. In some embodiments, the accumulator comprises a piston-type accumulator. In some embodiments, the accumulator comprises two or more accumulators.

In some embodiments, the hydraulic pump comprises a subsea hydraulic pump. In some embodiments, the hydraulic pump comprises a piston pump, diaphragm pump, centrifugal pump, vane pump, gear pump, gerotor pump, or screw pump. In some embodiments, the hydraulic pump comprises two or more hydraulic pumps.

Some embodiments comprise an electric motor coupled to the hydraulic pump and configured to actuate the hydraulic pump. In some embodiments, the electric motor comprises a synchronous alternating current (AC) motor, asynchronous AC motor, brushed direct current (DC) motor, brushless DC motor, or permanent magnet DC motor. In some embodiments, the electric motor comprises two or more electric motors.

Some embodiments comprise a battery coupled to the electric motor and configured to supply electrical power to the electric motor. In some embodiments, the battery is disposed within an atmospheric pressure vessel. In some embodiments, the battery is disposed within a pressure-compensated fluid-filled chamber. In some embodiments, the battery comprises two or more batteries. Some embodiments comprise an electrical connector coupled to the electric motor and configured to be coupled to an auxiliary cable to provide electrical power to the electric motor.

In some embodiments, the valve of the drain is configured to drain hydraulic fluid from the hydraulic power storage system at a pre-determined flow rate. Some embodiments comprise a flow sensor configured to capture data indicative of a flow rate of hydraulic fluid through the valve of the drain. Some embodiments comprise a processor configured to determine a variance between a flow rate indicated in data captured by the flow sensor and a pre-determined flow rate and actuate the valve of the drain to reduce the variance. In some embodiments, the valve of the drain is configured to drain hydraulic fluid from the hydraulic power storage system to a subsea environment. Some embodiments comprise a reservoir configured to supply hydraulic fluid to the hydraulic pump. In some embodiments, the valve of the drain is configured to drain hydraulic fluid from the hydraulic power storage system to the reservoir. In some embodiments, the flow restrictor comprises an orifice.

Some embodiments comprise one or more valves in fluid communication with the hydraulic power storage system and the hydraulic pump, where the one or more valves are configured to control hydraulic fluid communication between the hydraulic power storage system and the hydraulic pump. In some embodiments, the one or more valves comprises a one-way valve configured to prevent hydraulic fluid communication from the hydraulic power storage system to the hydraulic pump.

Some embodiments of the present methods comprise: increasing, with a hydraulic pump, an internal pressure of an accumulator of a hydraulic power storage system, draining hydraulic fluid from the hydraulic power storage system, through a flow restrictor, and to at least one of a reservoir and a subsea environment such that the internal pressure of the accumulator is reduced, if the internal pressure of the accumulator falls below a threshold pressure, increasing, with the hydraulic pump, the internal pressure of the accumulator to a pressure that is above the threshold pressure, and, supplying, with the accumulator, pressurized hydraulic fluid to a hydraulically actuated device to actuate the hydraulically actuated device. In some embodiments, the hydraulic fluid comprises at least one of: sea water, desalinated water, treated water, and an oil-based fluid.

Some embodiments comprise supplying, with the hydraulic pump, pressurized hydraulic fluid to the hydraulically actuated device to actuate the hydraulically actuated device. Some embodiments comprise supplying hydraulic fluid from a reservoir to the hydraulic pump. Some embodiments comprise supplying hydraulic fluid from an above-surface hydraulic fluid source to the hydraulic pump. Some embodiments comprise supplying hydraulic fluid from a subsea environment to the hydraulic pump. Some embodiments comprise supplying hydraulic fluid from a remotely operated underwater vehicle (ROV)-mounted hydraulic fluid source to the hydraulic pump.

In some embodiments, the draining hydraulic fluid comprises draining hydraulic fluid at a pre-determined flow rate. In some embodiments, the draining hydraulic fluid comprises actuating a valve to drain hydraulic fluid from the hydraulic power storage system. In some embodiments, the draining hydraulic fluid comprises draining hydraulic fluid to the reservoir.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

Figure 1:
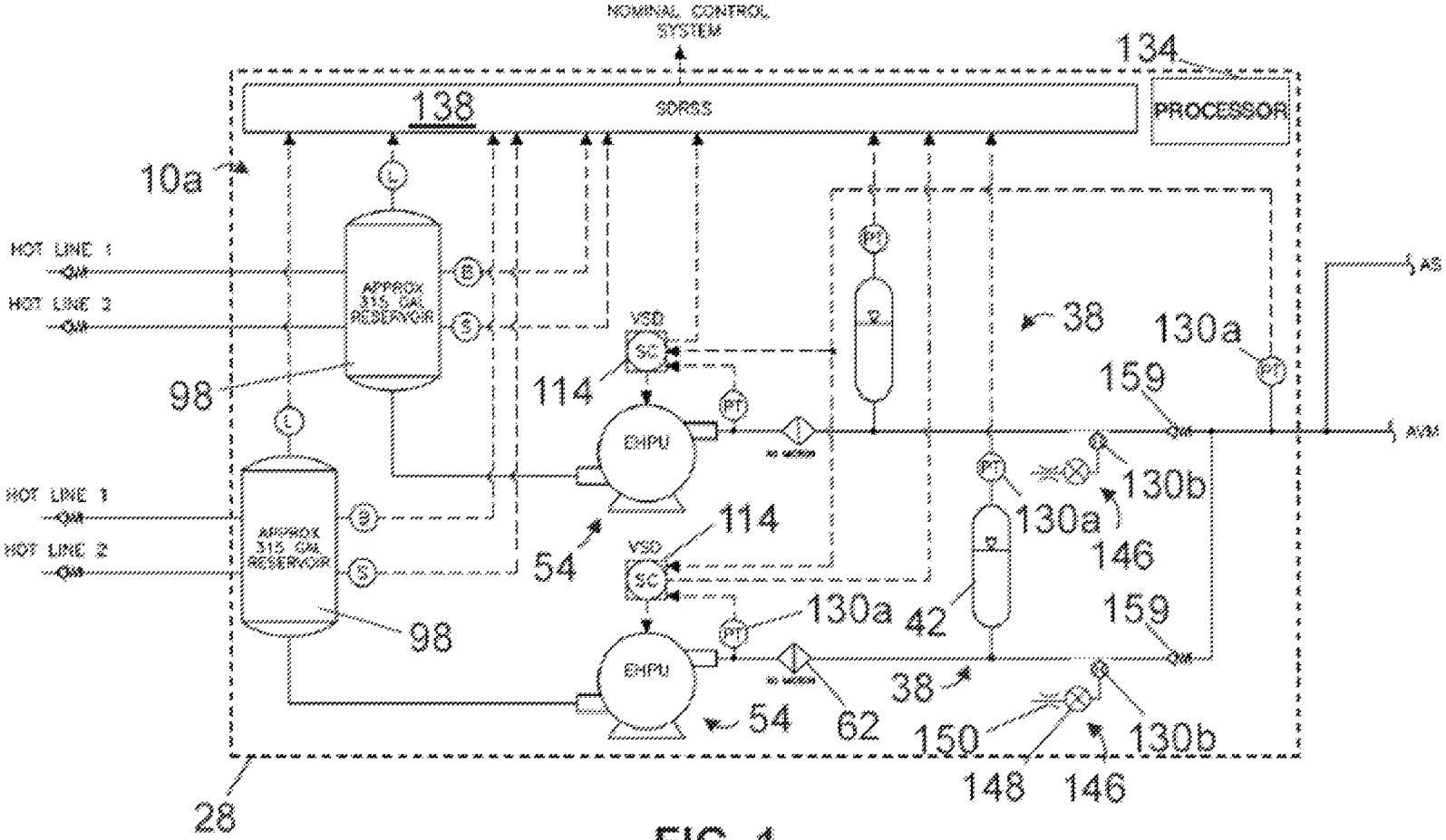
FIG. 1 is a diagram of a first embodiment of the present systems.
Figure 2B:
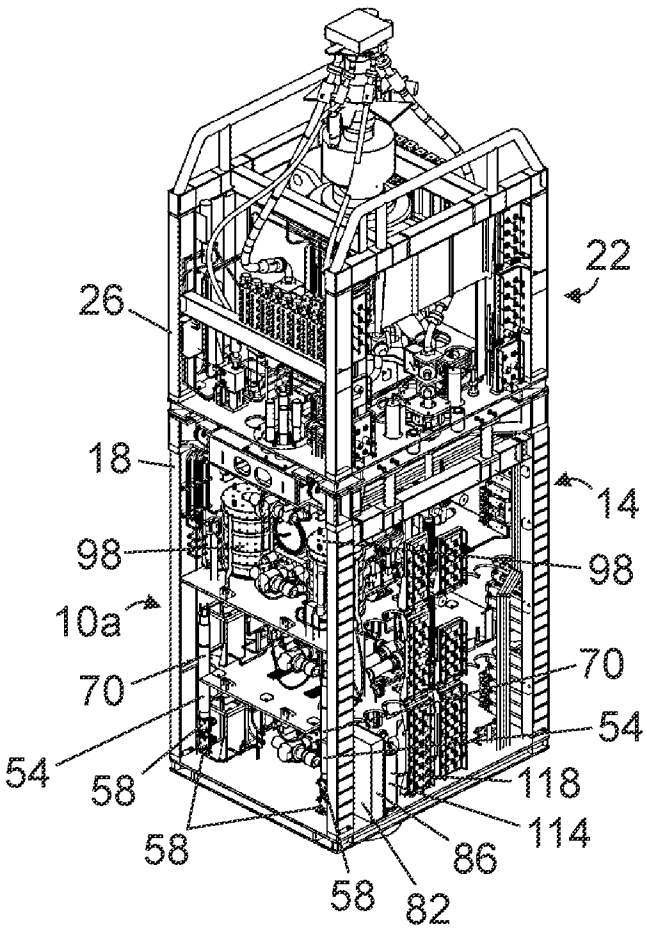
FIGS. 2A and 2B are perspective views of the system of FIG. 1, shown coupled to a blowout preventer stack (for clarity, accumulator(s) of the system are not shown).
Figure 2A:
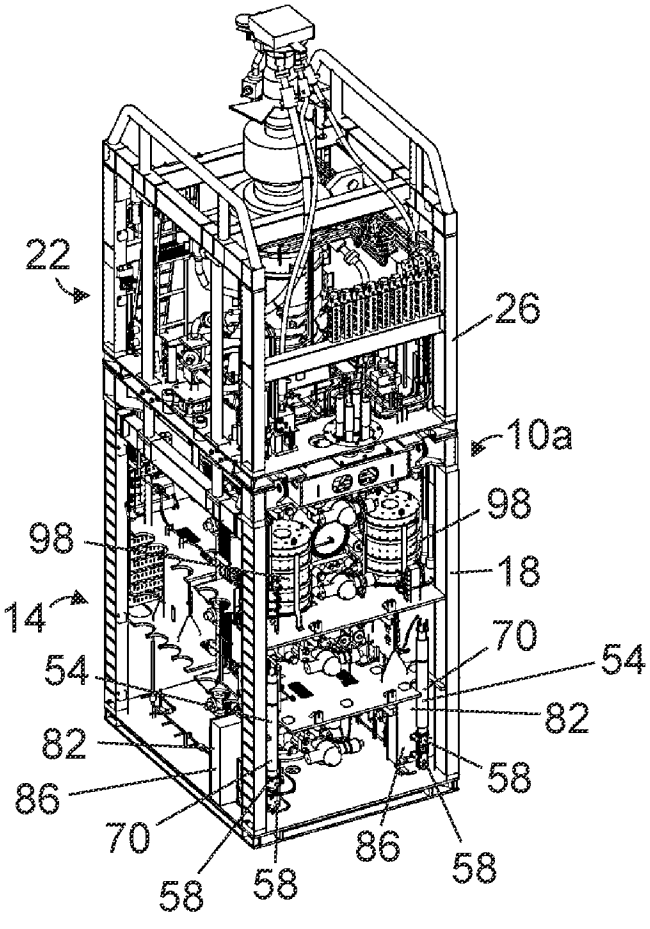

Referring now to the figures, and more particularly to FIGS. 1, 2A, and 2B, shown therein and designated by the reference numeral 10*a* is a first embodiment of the present systems. In the embodiment shown, at least some components of system 10*a* (e.g., hydraulic power storage system(s) 38, accumulator(s) 42, hydraulic power production system(s) 54, hydraulic pump(s) 58, electric motor(s) 70, batter(ies) 82 (i.e., one or more batteries), reservoir(s) 98, electric motor speed controller(s) 114, sensor(s) 130, drain(s) 146, and/or the like) are configured to be coupled to a blowout preventer (BOP) stack 14, and more particularly, to a support frame 18 of the BOP stack or a support frame 26 of a lower marine riser package (LMRP) 22 that is coupled to the BOP stack. In at least this way, some embodiments of the present systems (e.g., 10*a*, 10*b*, and/or the like) may be configured to be retrofitted onto an existing BOP stack, whether the existing BOP stack is deployed subsea, in use, or otherwise. However, the present systems (e.g., 10*a*, 10*b*, and/or the like) may be configured to be coupled to and/or comprise a skid (e.g., 28), which may be designed to rest on a sea floor.

In this embodiment, system 10*a* is configured to actuate a hydraulically actuated device, and more particularly, a hydraulically actuated device of BOP stack 14 or LMRP 22, such as, for example, a ram, annular, accumulator, test valve, failsafe valve, kill and/or choke line and/or valve, riser joint, hydraulic connector, and/or the like. Such hydraulically actuated devices may vary in operational hydraulic fluid flow rate and pressure requirements. For example, some hydraulically actuated devices may require a hydraulic fluid flow rate of between 3 gallons per minute (gpm) and 130 gpm and a hydraulic fluid pressure of between 500 pounds per square inch gauge (psig) and 5,000 psig for effective and/or desirable operation. Thus, embodiments of the present systems (e.g., 10*a*, 10*b*, and/or the like) configured to actuate such hydraulically actuated devices may be configured to output hydraulic fluid at the flow rates and pressures identified above via, for example, one or more accumulators 42 and/or one or more hydraulic pumps 58, each described in more detail below.

In the depicted embodiment, system 10*a* includes one or more hydraulic power storage systems 38, each including one or more accumulators 42 (e.g., two (2) accumulators 42, as shown) configured to supply pressurized hydraulic fluid to a hydraulically actuated device to actuate the hydraulically actuated device. One or more accumulators 42 may include pre-existing accumulator(s) of a BOP stack 14 and/or may be retrofitted onto the BOP stack along with other components of system 10*a*. The present systems may include any suitable number of hydraulic power storage system(s) (e.g., 38), each including any suitable number of accumulator(s) (e.g., 42), such as, for example, 1, 2, 3, 4, 5, 6, 7, 8, 9, 10, or more accumulator(s), and such accumulator(s) may comprise any suitable accumulator, such as, for example, a piston-type, bladder-type, and/or the like accumulator.

Figure 3:
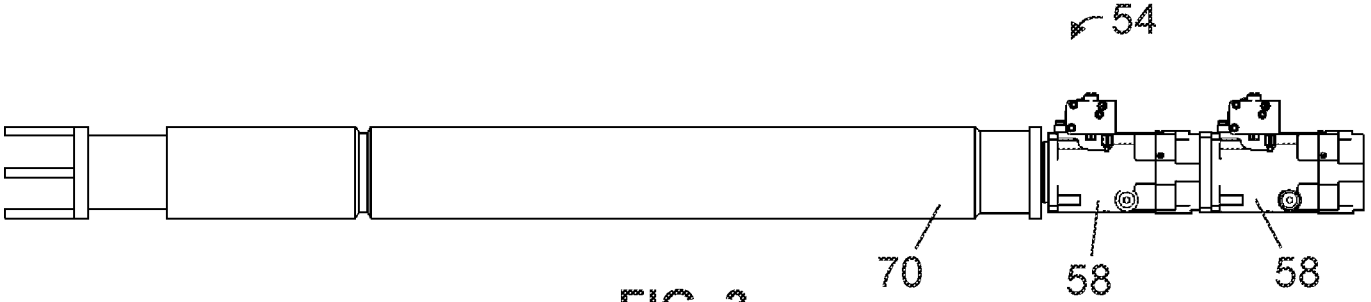
FIG. 3 is a side view of a hydraulic power production system, which may be suitable for use in some embodiments of the present systems.
Figure 4B:
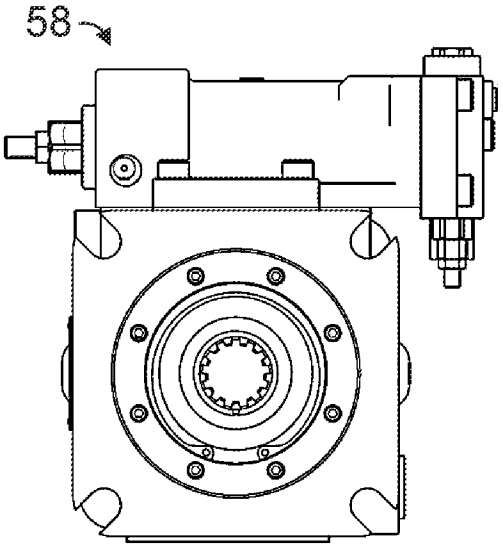
FIGS. 4A and 4B are side and front views, respectively, of a hydraulic pump, which may be suitable for use in some embodiments of the present systems.
Figure 4A:
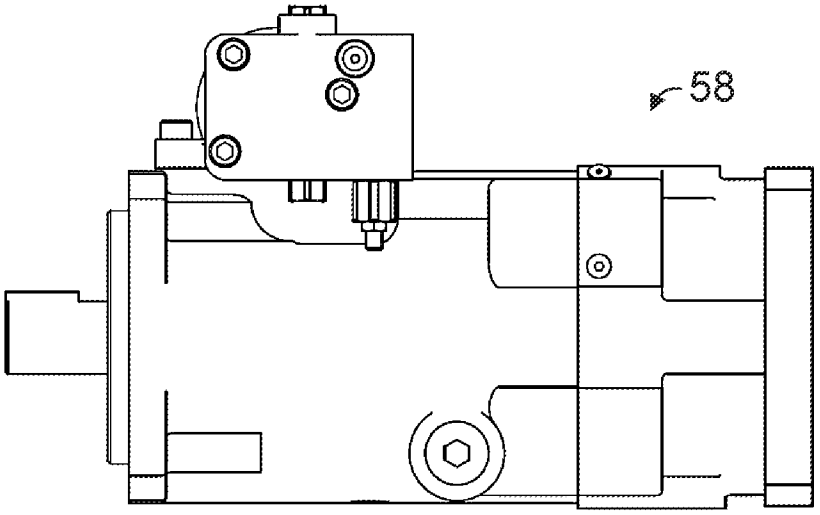

Referring additionally to FIGS. 3, 4A, and 4B, in the embodiment shown, system 10*a* includes one or more hydraulic power production systems 54 (e.g., two (2) hydraulic power production systems, as shown), each configured to pressurize one or more hydraulic power storage systems 38. For example, in this embodiment, each hydraulic power production system 54 includes one or more subsea hydraulic pumps 58 (e.g., two (2) hydraulic pumps, as shown, whether hydraulically in series or in parallel) configured to pressurize one or more accumulators 42 of one or more hydraulic power storage systems 38. More particularly, in the depicted embodiment, hydraulic pump(s) 58 of a first hydraulic power production system 54 are configured to pressurize accumulator(s) 42 of a first hydraulic power storage system 38, and hydraulic pump(s) 58 of a second hydraulic power production system 54 are configured to pressurize accumulator(s) 42 of a second hydraulic power storage system 38. However, the present systems may include any suitable number of hydraulic power production system(s) (e.g., 54), each including any suitable number of hydraulic pump(s) (e.g., 58), such as, for example, 1, 2, 3, 4, 5, 6, 7, 8, 9, 10, or more hydraulic pump(s), and configured to pressurize any suitable of accumulator(s) (e.g., 42) of any suitable number of hydraulic power storage system(s) (e.g., 38).

In the embodiment shown, each hydraulic pump 58 comprises an axial piston pump, which may be capable of providing continuous pressure at or above 5,000 psig and peak pressure at or above 5,800 psig, such as, for example, an OILGEAR PVG-150 axial piston hydraulic pump, available from The Oilgear Company, 2300 S. 51$^{st}$ Street, Milwaukee, Wis. 53219. However hydraulic pump(s) (e.g., 58) of the present systems (e.g., 10*a*, 10*b*, and/or the like) may comprise any suitable hydraulic pump, such as, for example, a piston, diaphragm, centrifugal, vane, gear, gerotor, screw, and/or the like hydraulic pump.

In the embodiment shown, each of one or more hydraulic pumps 58 may be further configured to supply pressurized fluid to a hydraulically actuated device to actuate the hydraulically actuated device. Hydraulic pumps (e.g., 58) may not be subject to certain depth-related limitations of other sources of high pressure hydraulic fluid, such as accumulators, and therefore, may be particularly suited for use as a source of high pressure hydraulic fluid for mitigating such depth-related limitations (e.g., by pressurizing (e.g., charging or re-charging) accumulators), actuating subsea hydraulically actuated devices, and/or the like.

Some embodiments of the present systems (e.g., 10*a*, 10*b*, and/or the like) may be configured to provide for increased fault-tolerance. For example, in this embodiment, each hydraulic power production system 54 (e.g., hydraulic pump(s) 58 of each hydraulic power production system) may be capable of pressurizing a hydraulic power storage system 38 (e.g., one or more accumulators 42 thereof) to, and/or providing pressurized hydraulic fluid to a hydraulically actuated device at, a flow rate and pressure sufficient to actuate a hydraulically actuated device that system 10*a* is intended to actuate. Thus, in the depicted embodiment, one hydraulic power production system 54 and/or one hydraulic pump 58 may be sufficient to ensure proper actuation of a hydraulically actuated device. Additionally, in the embodiment shown, at least by including multiple hydraulic power production systems 54, hydraulic pumps 58, hydraulic power storage systems 38, and/or accumulators 42, system 10*a* may, through redundancy, provide for increased fault-tolerance (e.g., system 10*a* may be capable of actuating a hydraulically actuated device even if a hydraulic power production system 54, hydraulic pump 58, hydraulic power storage system 38, and/or accumulator 42 malfunctions or fails).

In this embodiment, system 10*a* includes one or more filters 62 (e.g., two (2) filters, as shown), each hydraulically disposed between a hydraulic power production system 54 and a hydraulic power storage system 38 that is configured to be pressurized by the hydraulic power production system. Provided by way of example, in the depicted embodiment, each filter 62 comprises a 40 micron filter. At least through such filter(s) 62, system 10*a* may be configured to remove contaminants from hydraulic fluid to prevent the contaminants from reaching a hydraulic power storage system 38 and/or a hydraulically actuated device. The presence of filter(s) (e.g., 62) in a given system may depend on, for example, hydraulic pump (e.g., 58) manufacturer recommendations and/or requirements, hydraulic fluid quality, and/or the like, and thus, such filter(s) may not be present in some embodiments of the present systems.

Figure 5:
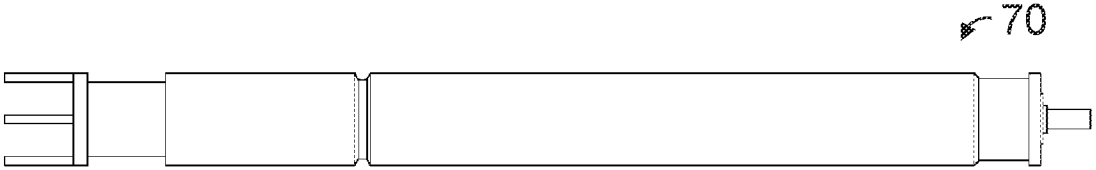
FIG. 5 is a side view of an electric motor, which may be suitable for use in some embodiments of the present systems.

Referring additionally to FIG. 5, in the embodiment shown, system 10*a* (e.g., each hydraulic power production system 54) includes one or more electric motors 70 configured to be coupled to one or more hydraulic pumps 58 and to actuate the one or more hydraulic pumps. For example, in this embodiment, each hydraulic power production system 54 includes one electric motor 70 configured to be coupled to two (2) hydraulic pumps 58 and to actuate the two hydraulic pumps (FIG. 3). Nevertheless, hydraulic power production system(s) (e.g., 54) of the present systems (e.g., 10*a*, 10*b*, and/or the like) may include any suitable number of electric motors (e.g., 70), such as, for example, 1, 2, 3, 4, 5, 6, 7, 8, 9, 10, or more electric motor(s), and such electric motor(s) may be configured to be operatively coupled to any suitable number of hydraulic pump(s) (e.g., 58) (e.g., two or more electric motors configured to be operatively coupled to one hydraulic pump, one electric motor configured to be operatively coupled to two or more hydraulic pumps, and/or the like).

In the embodiment shown, each electric motor 70 comprises an electric motor that may be capable of producing at least 350 horsepower (hp), such as, for example, one available from Submersible Motor Engineering (SME), 950 S. 67$^{th}$ Avenue, Phoenix, Ariz. 85043. Nevertheless, electric motor(s) (e.g., 70) of the present systems (e.g., 10*a*, 10*b*, and/or the like) may comprise any suitable electric motor, such as, for example, any suitable synchronous alternating current (AC), asynchronous AC, brushed direct current (DC), brushless DC, permanent magnet DC, and/or the like electric motor.

Figure 6A:
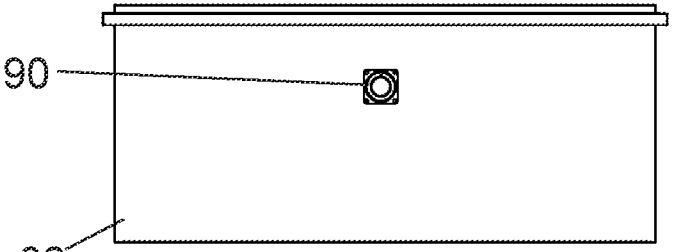
FIGS. 6A and 6B are front and side views, respectively, of a battery, which may be suitable for use in some embodiments of the present systems.
Figure 6B:
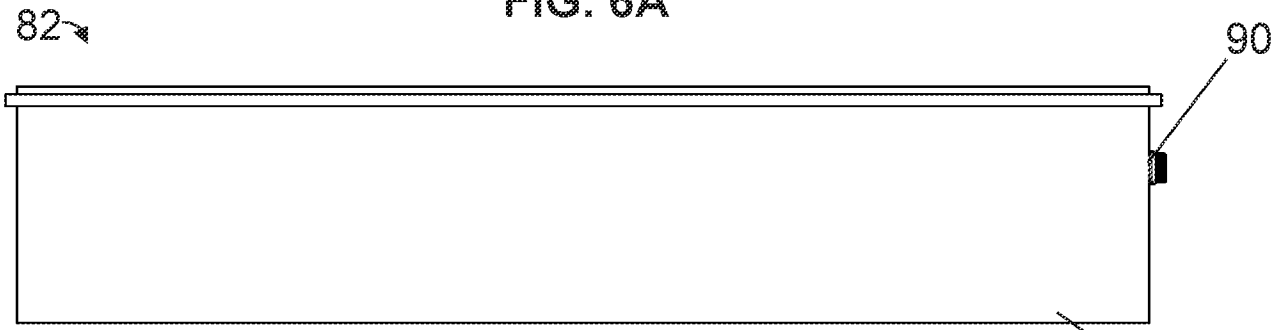

Referring additionally to FIGS. 6A and 6B, in the depicted embodiment, system 10*a* includes one or more batteries 82, each comprising any suitable number of cell(s) and configured to be coupled to one or more electric motors 70 and to supply electrical power to the one or more electric motors. The present systems (e.g., 10*a*, 10*b*, and/or the like) may include any suitable number of batter(ies), such as, for example, 1, 2, 3, 4, 5, 6, 7, 8, 9, 10, or more batter(ies). Batter(ies) 82 may each be operatively coupled to electric motor(s) 70 of respective hydraulic power production system(s) 54, operatively coupled to electric motors of hydraulic power production systems that are distinct from one another (e.g., shared by two or more hydraulic power production systems), and/or the like.

In this embodiment, each battery 82 comprises at least a 19 kilowatt hour (kWh) subsea battery, such as, for example, one available from Southwest Electronic Energy Group (SWE), 823 Buffalo Run, Missouri City, Tex. 77489. Nevertheless, batter(ies) (e.g., 82) of the present systems (e.g., 10*a*, 10*b*, and/or the like) may comprise any suitable battery, such as, for example, a lithium-ion, nickel-metal hydride, nickel-cadmium, lead-acid, and/or the like battery.

In this embodiment, each battery 82 is disposable within and/or includes a fluid-filled chamber 86, such as, for example, a chamber filled with a non-conductive substance (e.g., a dielectric substance) (though more than one battery may be disposed within a single chamber). In some embodiments, each chamber (e.g., 86) may be pressure-compensatable via, for example, a piston, flexible bladder, diaphragm, and/or the like that is configured to provide for a pressure within the fluid-filled chamber that equals or exceeds a pressure of a subsea environment outside of the fluid-filled chamber. In other embodiments, each battery (e.g., 82) may be disposable within and/or include an atmospheric pressure vessel, such as, for example, a vessel configured to have an internal pressure of approximately 1 atmosphere (atm).

Batteries (e.g., 82) may be less susceptible to depth-related limitations than are other energy storage devices, such as accumulators, and/or may be configured to occupy a smaller volume and/or have a lower weight than other such energy storage devices; therefore, batteries may be particularly suited for use as an energy storage device to provide at least a portion of an energy necessary (e.g., to an electric motor 70 operatively coupled to a hydraulic pump 58) to pressurize (e.g., charge or re-charge) an accumulator 42, actuate a subsea hydraulically actuated device, and/or the like.

In the embodiment shown, system 10*a* comprises one or more electrical connectors 90, each configured to be coupled to an auxiliary cable to provide electrical power to system component(s). For example, in this embodiment, power provided via an auxiliary cable through one or more electrical connectors 90 may be used to, power one or more hydraulic power production systems 54 (e.g., one or more electric motors 70 and/or one or more electric motor speed controllers 114 thereof), charge one or more batteries 82, and/or the like.

Figure 7:
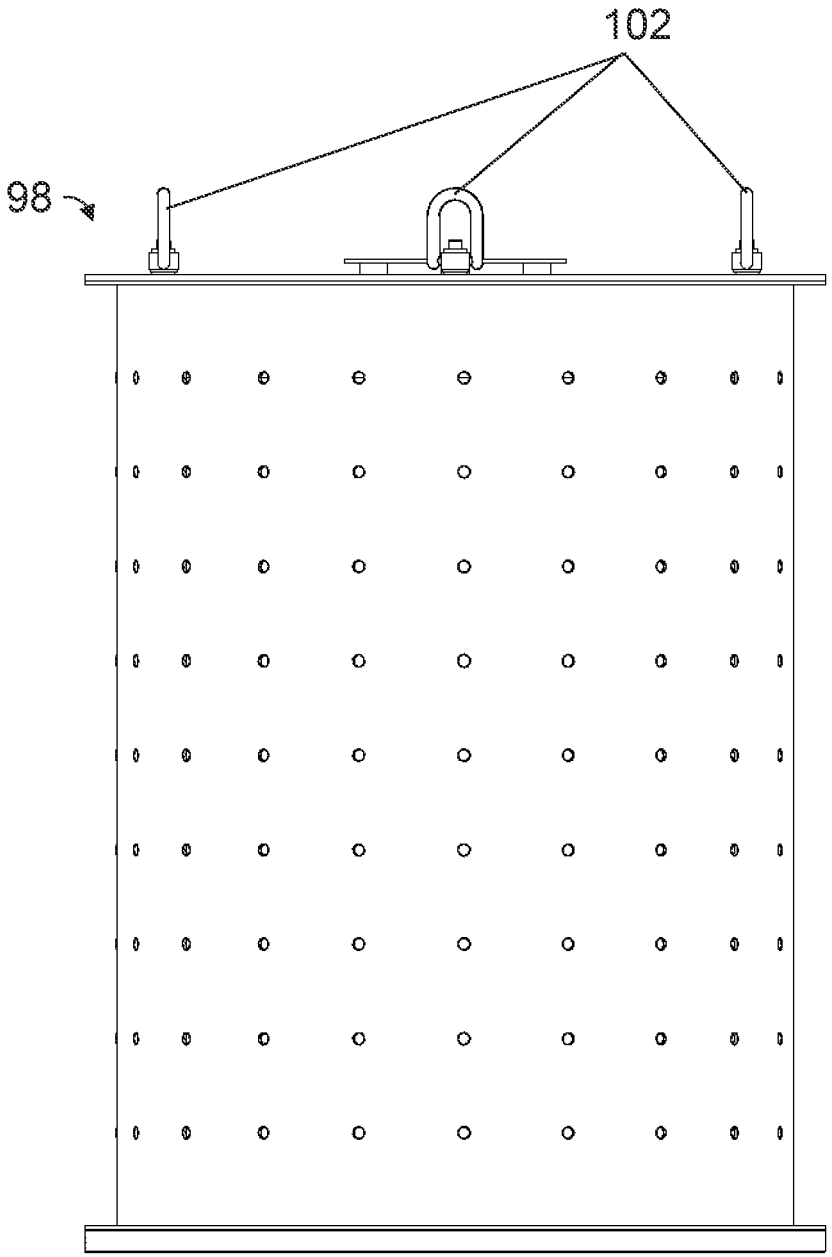
FIG. 7 is a front view of a reservoir, which may be suitable for use in some embodiments of the present systems.

Referring additionally to FIG. 7, in the depicted embodiment, system 10*a* includes one or more reservoirs 98 (e.g., two reservoirs 98, as shown), each configured to supply hydraulic fluid to at least one hydraulic power production system 54 (e.g., hydraulic pump(s) 58 thereof). In the embodiment shown, each reservoir 98 may be configured to receive and/or store hydraulic fluid from a rigid conduit, hotline, and/or the like (e.g., such that the reservoir may be filled and/or re-filled from an above-surface hydraulic fluid source) and/or from a remotely-operated vehicle (ROV), drain 146, hydraulically actuated device, subsea environment, and/or the like (e.g., such that the reservoir may be filled and/or re-filled from a subsea hydraulic fluid source). Reservoir(s) (e.g., 98) of the present disclosure may include any suitable number of reservoirs, such as, for example, 1, 2, 3, 4, 5, 6, 7, 8, 9, 10, or more reservoir(s), and such reservoir(s) may include any suitable structure that is capable of receiving and/or storing hydraulic fluid.

In this embodiment, each reservoir 98 includes one or more lugs 102 configured to facilitate installation and/or removal of the reservoir to and/or from, for example, support frame 18 of BOP stack 14 and/or support frame 26 of LMRP 22. In some embodiments of the present systems, such lug(s) (e.g., 102) or similar features may be included by component(s) other than reservoir(s) (e.g., 98), such as, for example, accumulator(s) (e.g., 42), hydraulic pump(s) (e.g., 58), electric motors (e.g., 70), batter(ies) (e.g., 82), electric motor speed controller(s) (e.g., 114), and/or the like.

Figure 8:
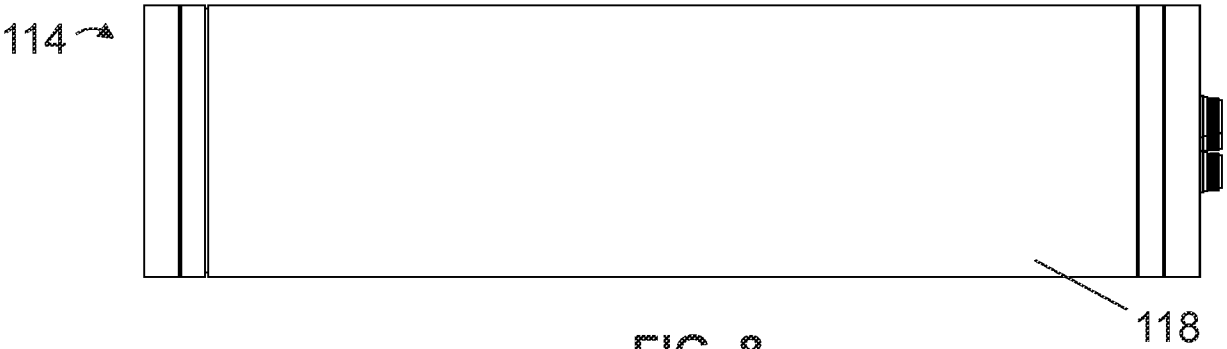
FIG. 8 is a side view of an electric motor speed controller, which may be suitable for use in some embodiments of the present systems.

Referring additionally to FIG. 8, in the depicted embodiment, system 10*a* includes one or more electric motor speed controllers 114, each configured to be coupled to one or more electric motors 70 and to control (e.g., activate, deactivate, change or set a rotational speed of, and/or the like) the one or more electric motors. Electric motor speed controller(s) 114 may each be operatively coupled to electric motor(s) 70 of respective hydraulic power production system(s) 54, operatively coupled to electric motors of hydraulic power production systems that are distinct from one another (e.g., such that the electric motor speed controller is configured to control electric motors of at least two hydraulic power production systems), and/or the like. In this embodiment, each electric motor speed controller 114 comprises a variable frequency or variable speed drive; however, in other embodiments, electric motor speed controller(s) (e.g., 114) may comprise any suitable controller that is capable of controlling an electric motor.

Similarly to as described above for one or more batteries 82, in the depicted embodiment, each electric motor speed controller 114 is disposable within and/or includes a fluid-filled chamber 118, which may be pressure-compensatable (though more than one electric motor speed controller may be disposed within a single chamber). Alternatively, and also as described above for one or more batteries 82, in some embodiments, one or more electric motor speed controllers (e.g., 114) may each be disposable within and/or include an atmospheric pressure vessel.

In the embodiment shown, system 10*a* comprises one or more sensors 130 configured to capture data indicative of at least one of pressure, flow rate, temperature, and/or the like of hydraulic fluid within the system, such as, for example, within or at an outlet of the system, a hydraulic power production system 54, a hydraulic pump 58, a hydraulic power storage system 38, and/or an accumulator 42. Sensor (s) (e.g., 130) of the present systems (e.g., 10*a*, 10*b*, and/or the like) may comprise any suitable sensor, such as, for example, a pressure sensor (e.g., a piezoelectric pressure sensor, strain gauges, and/or the like), flow sensor (e.g., a turbine, ultrasonic, Coriolis, and/or the like flow sensor, a flow sensor configured to determine or approximate a flow rate based, at least in part, on data indicative of pressure, and/or the like), temperature sensor (e.g., a thermocouple, resistance temperature detector (RTD), and/or the like), position sensor (e.g., a Hall effect sensor, potentiometer, and/or the like), and/or the like.

In this embodiment, each electric motor speed controller 114 may be configured and/or commanded (e.g., by a processor 134) to control one or more electric motors 70 based, at least in part, on data captured by one or more sensors 130. For example, in the depicted embodiment, system 10*a* may be configured to maintain a target or threshold pressure within one or more hydraulic power storage systems 38, such as within accumulator(s) 42 of the hydraulic power storage system(s), that is constant or defined as a range of pressures (e.g., at or between 4,000 psig and 5,000 psig). In the embodiment shown, if a pressure within the hydraulic power storage system(s), as indicated in data captured by one or more sensors 130*a*, falls below the target or threshold pressure, one or more hydraulic power production systems 54 may be controlled to increase the pressure within the hydraulic power storage system(s), for example, via one or more electric motor speed controllers 114 activating or increasing a rotational speed of one or more electric motors 70 coupled to one or more hydraulic pumps 58 of the hydraulic power production system(s). Alternatively, if a pressure within the hydraulic power storage system(s), as indicated in data captured by one or more sensors 130*a*, rises above the target or threshold pressure, one or more hydraulic power production systems 54 may be controlled to decrease (or cease increasing) the pressure within the hydraulic power storage system(s), for example, via one or more electric motor speed controllers 114 deactivating or decreasing a rotational speed of one or more electric motors 70 coupled to one or more hydraulic pumps 58 of the hydraulic power production system(s).

Figure 9:
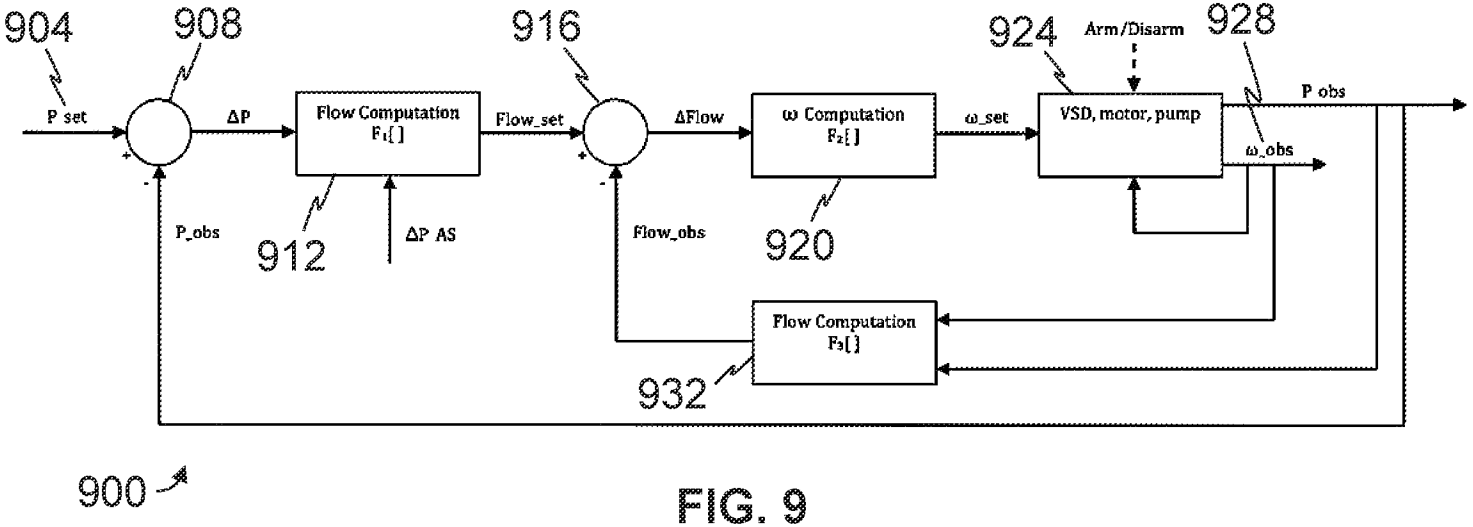
FIG. 9 is a diagram of a control system for a hydraulic power production system, which may be suitable for use with some embodiments of the present systems.

For further example, FIG. 9 is a diagram of a control system 900 for a hydraulic power production system 54, which may be suitable for use with some embodiments of the present systems. In system 10*a*, control system 900 may be implemented by one or more electric motor speed controllers 114 (e.g., implemented locally by the system); however, in other embodiments, control system 900 may be implemented by a processor (e.g., 134, which may or may not be local to the system) in communication with one or more electric motor speed controllers (e.g., 114). In the embodiment shown, at step 904, a threshold or target pressure for a system (e.g., 10*a*, 10*b*, and/or the like) may be set or input, such as, for example, a threshold or target pressure within or at an outlet of the system, a hydraulic power production system (e.g., 54), a hydraulic pump (e.g., 58), a hydraulic power storage system (e.g., 38), and/or an accumulator (e.g., 42). At step 908, in this embodiment, the threshold or target pressure may be compared to one or more observed pressures, which may be indicated in data captured by one or more sensors (e.g., 130*a*), to determine one or more pressure differentials between the threshold or target pressure and each of the one or more observed pressures.

In the depicted embodiment, at step 912, a target flow rate may be calculated based, at least in part, on the one or more pressure differentials. For example, in the embodiment shown, a first and second differential pressure, each corresponding to location within the system that is upstream or downstream of a location corresponding to the other, may be used to calculate the target flow rate (e.g., considering a distance within the system between the corresponding locations of the first and second differential pressures, the geometry of hydraulic conduit(s), manifold(s), and/or the like of the system, and/or the like). At step 916, in the embodiment shown, the target flow rate may be compared to a observed flow rate, which may be indicated in and/or determined using (e.g., step 932, described below) data captured by one or more sensors (e.g., 130*b*), to determine a flow rate differential between the target flow rate and the observed flow rate.

In this embodiment, at step 920, the flow rate differential may be used to determine target rotational speed(s) for one or more electric motors (e.g., 70) and/or one or more hydraulic pumps (e.g., 58) coupled to the electric motor(s) to meet the target flow rate. For example, in the depicted embodiment, the determination of step 920 may be based, at least in part, on a known relationship between a rotational speed of an electric motor (e.g., 70) and/or of a hydraulic pump (e.g., 58) coupled to the electric motor and a flow rate of hydraulic fluid provided by the hydraulic pump, which may take into account volumetric efficiencies of the hydraulic pump, and/or the like. At step 924, in the depicted embodiment, one or more electric motor speed controllers (e.g., 114) may set the rotational speed of the electric motor(s) to the target rotational speed(s).

In the embodiment shown, at step 928, observed rotational speed(s) of the electric motor(s), which may be indicated in data captured by one or more sensors (e.g., 130), may be fed back to the electric motor speed controller(s) (e.g., to determine if the electric motor(s) are operating at the target rotational speed(s) or if further adjustment(s) are necessary). At step 932, in this embodiment, the observed rotational speed(s) and/or one or more observed pressures may be used to determine the observed flow rate for input to step 916.

In some embodiments (e.g., 10*a*), contributions to observed value(s), such as, for example, observed pressure (s), observed flow rate(s), and/or the like by a hydraulic power production system may be considered by electric motor speed controller(s) (e.g., 114) during control of other hydraulic power production system(s) (e.g., depending on the location of sensor(s) 130, some of which may be placed in communication with a conduit or manifold that is in communication with each hydraulic power production system); therefore, in these embodiments, target value(s), such as, for example, target pressure(s), target flow rate(s), and/or the like may be met by contributions from each of the hydraulic power production systems (e.g., each operating at less than full flow), though such contributions need not be equal.

Returning to FIG. 1, in the depicted embodiment, each hydraulic power storage system 38 includes a drain 146 in fluid communication with one or more accumulators 42 and configured to drain hydraulic fluid from the hydraulic power storage system such that an internal pressure of an accumulator 42 is reduced. For example, in the embodiment shown, each drain 146 comprises a valve 148 (whether directional or proportional) that is actuatable or openable (e.g., under control of a processor 134) to drain hydraulic fluid from a hydraulic power storage system 38. In this embodiment, each drain 146 is configured to drain hydraulic fluid from a hydraulic power storage system 38 and to a subsea environment; however, in other embodiments of the present systems, a drain (e.g., 146) may be configured to drain hydraulic fluid from a hydraulic power storage system (e.g., 38) and to a reservoir (e.g., 98), for example, via a conduit in fluid communication between the drain and the reservoir, thereby conserving hydraulic fluid within the system when the drain is open. In this embodiment, each drain 146 is distinct from any hydraulically actuated device that system 10*a* is configured to actuate. A one-way valve 159 is disposed in the flow path between the drain 146 and the hydraulically actuated device and configured to prevent flow in a direction from the hydraulically actuated device toward the drain 146.

In the depicted embodiment, each drain 146 includes a flow restrictor 150 configured to reduce a flow rate of hydraulic fluid through its valve 148, such as, for example, a device or structure that functions to reduce a cross-sectional area through which hydraulic fluid may flow. For example, in the embodiment shown, each flow restrictor 150 comprises an orifice; however, other embodiments of the present systems may comprise any suitable flow restrictor. In some embodiments, a valve (e.g., 148) may include and/or function as a flow restrictor (e.g., 150) and/or the valve and the flow restrictor may be comprised by the same component, as in, for example, a proportional valve, which may be actuatable to a first position, in which flow through the valve is blocked, a second position, in which flow through the valve is permitted, and one or more positions in between the first and second positions in which flow through the valve is restricted relative to flow through the valve when the valve is in the second position. In these ways and others, some embodiments of the present systems (e.g., 10*a*, 10*b*, and/or the like) may be configured such that hydraulic fluid may be drained from hydraulic power storage system(s) (e.g., 38) through drain(s) (e.g., 146) at relatively low flow rate(s) (e.g., under 10 gpm), facilitating maintenance, removal, and/or testing of the system and/or system components (described in more detail below). In embodiments comprising proportional valve(s) as valve(s) 48 and flow restrictor(s) 150 of drain(s) 146, hydraulic fluid may also be drained from hydraulic power storage system(s) (e.g., 38) through the drain(s) at relatively high flow rate(s) (e.g., approximately 120 gpm) (e.g., facilitating testing of the system and/or system components at flow rate(s) required to actuate hydraulically actuated device(s) that the system is configured to actuate).

In this embodiment, each drain 146 is configured to drain hydraulic fluid from a hydraulic power storage system 38 at a pre-determined flow rate (e.g., whether defined by a single flow rate or a range of flow rates). For example, in the depicted embodiment, each drain 146 is coupled to a flow sensor 130*b* configured to capture data indicative of a flow rate of hydraulic fluid through valve 148 of the drain. In the embodiment shown, system 10*a* includes a processor (e.g., 134) configured to determine (e.g., by comparison) a variance between a flow rate indicated in data captured by a flow sensor 130*b* and the pre-determined flow rate and actuate valve 148 of a corresponding drain 146 in order to reduce the variance.

In these ways and others, some embodiments of the present systems (e.g., 10*a*, 10*b*, and/or the like) may provide for assessable reliability of the system and/or system components through automatic, periodic, and/or self-testing, thereby providing for a source of high pressure hydraulic fluid with a relatively low probability of failure on demand. For example, in the embodiment shown, valve 148 of a drain 146 may be opened to drain hydraulic fluid from a hydraulic power storage system 38 (e.g., at any suitable flow rate, such as, for example, any one of those described above), causing a pressure within the hydraulic power storage system, such as a pressure within corresponding accumulator(s) 42, to fall. In this embodiment, the valve of the drain may be opened for a pre-determined duration, such as, for example, a period of seconds. Once the pressure within the hydraulic power storage system, as indicated in data captured by sensor(s) 130*a*, falls below a threshold pressure, such as, for example, below 4,000 psig, or upon command, hydraulic power production system(s) 54, and more specifically, hydraulic pump(s) 58 thereof, may be (e.g., automatically) activated to supply hydraulic fluid to the hydraulic power storage system until the pressure within the hydraulic power storage system is above the threshold pressure (e.g., is 100 psig above the threshold pressure, is at or above 5,000 psig, and/or the like). In the depicted embodiment, this process may be repeated at pre-determined intervals (e.g., once every 8 hours).

In this embodiment, one or more sensors 130 may be used to capture data, such as, for example, data indicative of a rotational speed, number of rotations, and/or the like of electric motor(s) 70 and/or hydraulic pump(s) 58. Such data may be reported to a (e.g., subsea) data relay and/or storage system 138. At least by analyzing such data, health and/or status information associated with system 10*a* and its components, including hydraulic power production system(s) 54, electric motor(s) 70, hydraulic pump(s) 58, hydraulic power storage system(s) 38, accumulator(s) 42, electric motor speed controller(s) 114, and/or the like, may be determined. For example, in some embodiments, a processor (e.g., 134) may be configured to compare more recently captured data with historical data to determine the health and/or status of a system (e.g., 10*a*, 10*b*, and/or the like) and/or its components. To illustrate, if recently captured data indicates that an electric motor 70 and/or a hydraulic pump 58 required or is requiring a higher rotational speed and/or more rotations to pressurize a hydraulic power storage system 38 than indicated in historical data, the health and/or status of the electric motor, hydraulic pump, a corresponding hydraulic power production system 54, and/or the hydraulic power storage system may be impaired. For further example, if data captured by one or more sensors 130 indicates that a pressure within a hydraulic power production system 54 is significantly greater than a pressure at or within a hydraulic power storage system 38 during pressurization of the hydraulic power storage system by the hydraulic power production system, a clogged filter 62 between the hydraulic power production system and the hydraulic power storage system may be indicated.

Figure 10:
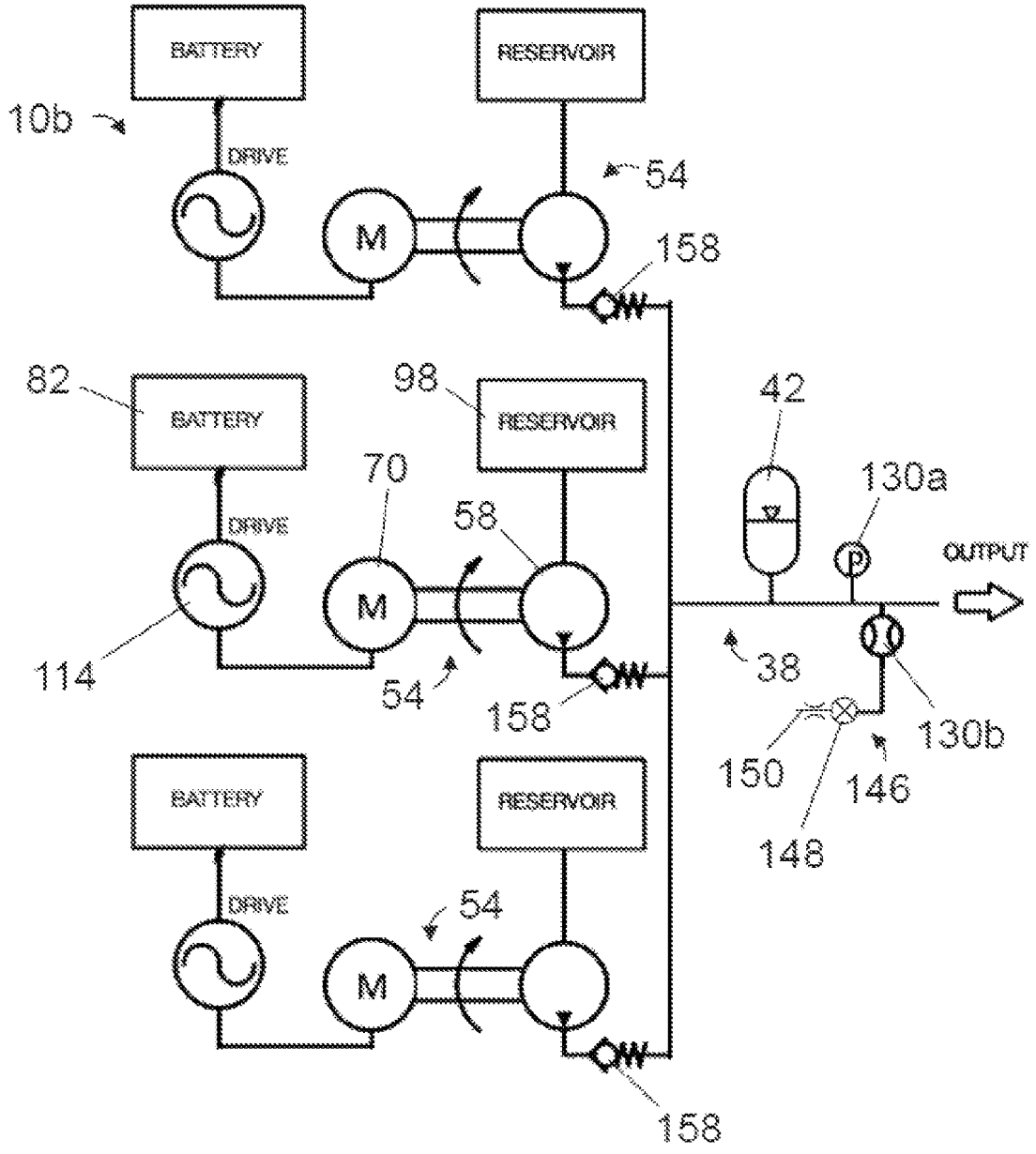
FIG. 10 is a diagram of a second embodiment of the present systems.

Referring now to FIG. 10, shown therein and designated by the reference numeral 10*b* is a second embodiment of the present systems. System 10*b* may be substantially similar to system 10*a*, with the primary exceptions described below. In the embodiment shown, system 10*b* includes three hydraulic power production systems 54, each including one hydraulic pump 58, configured to pressurize a single hydraulic power storage system 38. In this embodiment, system 10*b* includes one or more valves 158, each in communication between hydraulic power storage system 38 and a hydraulic power production system 54 (e.g., a hydraulic pump 58 thereof) and configured to control hydraulic fluid communication between the hydraulic storage system and the hydraulic power production system. For example, in the depicted embodiment, each valve 158 comprises a one-way valve configured to prevent hydraulic fluid communication between hydraulic power storage system 38 and a hydraulic power production system 54.

Some embodiments of the present methods for actuating a hydraulically actuated device comprise supplying, with an accumulator (e.g., 42) of a hydraulic power storage system (e.g., 38), pressurized hydraulic fluid to the hydraulically actuated device to actuate the hydraulically actuated device and, if an internal pressure of the accumulator falls below a threshold pressure, supplying, with a hydraulic pump (e.g., 58), pressurized hydraulic fluid to the hydraulically actuated device to actuate the hydraulically actuated device and increasing, with the hydraulic pump, the internal pressure of the accumulator to a pressure that is above the threshold pressure. Some embodiments comprise draining (e.g., with drain 146) hydraulic fluid from the hydraulic power storage system to at least one of a reservoir (e.g., 98) and a subsea environment.

Some embodiments of the present methods comprise increasing, with a hydraulic pump (e.g., 58), an internal pressure of an accumulator (e.g., 42) of a hydraulic power storage system (e.g., 38), draining hydraulic fluid from the hydraulic power storage system, through a flow restrictor (e.g., 150), and to at least one of a reservoir (e.g., 98) and a subsea environment such that the internal pressure of the accumulator is reduced, if the internal pressure of the accumulator falls below a threshold pressure, increasing, with the hydraulic pump, the internal pressure of the accumulator to a pressure that is above the threshold pressure, and supplying, with the accumulator, pressurized hydraulic fluid to a hydraulically actuated device to actuate the hydraulically actuated device. Some embodiments comprise supplying, with the hydraulic pump, pressurized hydraulic fluid to the hydraulically actuated device to actuate the hydraulically actuated device.

In some embodiments, the draining hydraulic fluid comprises draining hydraulic fluid at a pre-determined flow rate. In some embodiments, the draining hydraulic fluid comprises actuating a valve (e.g., 148) to drain hydraulic fluid from the hydraulic power storage system. In some embodiments, the draining hydraulic fluid comprises draining hydraulic fluid to the reservoir.

Some embodiments comprise supplying hydraulic fluid from a reservoir (e.g., 98) to the hydraulic pump. Some embodiments comprise supplying hydraulic fluid from an above-surface hydraulic fluid source (e.g., an above-surface hydraulic power unit, reservoir, and/or the like) to the hydraulic pump. Some embodiments comprise supplying hydraulic fluid from a subsea environment to the hydraulic pump. Some embodiments comprise supplying hydraulic fluid from a remotely operated underwater vehicle (ROV)-mounted hydraulic fluid source to the hydraulic pump. In some embodiments, the hydraulic fluid comprises at least one of: sea water, desalinated water, treated water, and an oil-based fluid.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system for actuating a hydraulically actuated device, the system comprising:

a hydraulic power storage system including:

an accumulator configured to supply pressurized hydraulic fluid to a hydraulically actuated device to actuate the hydraulically actuated device; and a drain in fluid communication with the accumulator and positioned in a flow path between the accumulator and the hydraulically actuated device, the drain comprising:

a valve that is actuatable to drain hydraulic fluid from the hydraulic power storage system such that an internal pressure of the accumulator is reduced; and a flow restrictor located downstream from the valve and configured to reduce a flow rate of hydraulic fluid through the valve;

a one-way valve disposed in the flow path between the drain and the hydraulically actuated device and configured to prevent flow in a direction from the hydraulically actuated device toward the drain;

a hydraulic pump configured to pressurize the accumulator;

a pressure sensor configured to capture data indicative of the internal pressure of the accumulator;

a flow sensor configured to capture data indicative of a flow rate of hydraulic fluid through the valve of the drain; and a processor configured to:

actuate the hydraulic pump to increase the internal pressure of the accumulator if the internal pressure of the accumulator, as indicated in data captured by the pressure sensor, falls below a threshold pressure;

determine a variance between a flow rate indicated in data captured by the flow sensor and a pre-determined flow rate; and actuate the valve of the drain to alter the variance.

2. The system of claim 1, wherein the processor is configured to deactivate the hydraulic pump if the internal pressure of the accumulator, as indicated in data captured by the pressure sensor, rises above a second threshold pressure.

3. The system of claim 1, wherein the accumulator comprises a bladder-type accumulator or a piston-type accumulator.

4. The system claim 1, wherein the valve of the drain is configured to drain hydraulic fluid from the hydraulic power storage system at the pre-determined flow rate.

5. The system of claim 1, wherein the valve of the drain is configured to drain hydraulic fluid from the hydraulic power storage system to a subsea environment.

6. The system of claim 1, comprising:

a reservoir configured to supply hydraulic fluid to the hydraulic pump;

wherein the valve of the drain is configured to drain hydraulic fluid from the hydraulic power storage system to the reservoir.

7. The system of claim 1, wherein the flow restrictor comprises an orifice.

8. The system of claim 1, wherein the hydraulic pump comprises a subsea hydraulic pump.

9. The system of claim 8, comprising an electric motor coupled to the hydraulic pump and configured to actuate the hydraulic pump.

10. A method comprising:

increasing, with a hydraulic pump, an internal pressure of an accumulator of a hydraulic power storage system;

draining hydraulic fluid from the hydraulic power storage system, through a drain comprised of an actuatable valve and a flow restrictor located downstream from the valve, and to at least one of a reservoir and a subsea environment such that the internal pressure of the accumulator is reduced, wherein the drain is positioned in a flow path between the accumulator and a hydraulically actuated device, wherein the draining hydraulic fluid includes actuating the valve to drain hydraulic fluid from the hydraulic power storage system;

if the internal pressure of the accumulator falls below a threshold pressure, increasing, with the hydraulic pump, the internal pressure of the accumulator to a pressure that is above the threshold pressure; and supplying, with the accumulator, pressurized hydraulic fluid through a one-way valve disposed in the flow path between the drain and the hydraulically actuated device and to the hydraulically actuated device to actuate the hydraulically actuated device;

capturing, with a flow sensor, data indicative of a flow rate of hydraulic fluid through the valve;

determining, with a processor, a variance between a flow rate indicated in data captured by the flow sensor and a pre-determined flow rate; and actuating the valve to alter the variance.

11. The method of claim 10, comprising supplying, with the hydraulic pump, pressurized hydraulic fluid to the hydraulically actuated device to actuate the hydraulically actuated device.

12. The method of claim 10, wherein the draining hydraulic fluid comprises draining hydraulic fluid at the pre-determined flow rate.

13. The method of claim 10, comprising:

supplying hydraulic fluid from a reservoir to the hydraulic pump;

wherein the draining hydraulic fluid comprises draining hydraulic fluid to the reservoir.

14. The method of claim 10, comprising supplying hydraulic fluid from a subsea environment to the hydraulic pump.

15. The method of claim 10, comprising supplying hydraulic fluid from a remotely operated underwater vehicle (ROV)-mounted hydraulic fluid source to the hydraulic pump.

16. The method of claim 10, wherein the actuating the valve includes actuating the valve to reduce the variance.

* * * * *